US011149441B2

(12) United States Patent
Baert et al.

(10) Patent No.: US 11,149,441 B2
(45) Date of Patent: Oct. 19, 2021

(54) PANEL AND METHOD OF PRODUCING A PANEL

(71) Applicant: Champion Link International Corporation, The Valley (AI)

(72) Inventors: Thomas Luc Martine Baert, Sint-Martens-Latem (BE); Tom Van Poyer, Jiaxing (CN); Sven Boon, Jiaxing (CN)

(73) Assignee: CHAMPION LINK INTERNATIONAL CORPORATION

( * ) Notice: Subject to any disclaimer, the term of this patent is extended or adjusted under 35 U.S.C. 154(b) by 0 days.

(21) Appl. No.: 16/817,866

(22) Filed: Mar. 13, 2020

(65) Prior Publication Data

US 2021/0285230 A1 Sep. 16, 2021

(51) Int. Cl.

| | |
|---|---|
| ***E04F 13/14*** | (2006.01) |
| ***E04F 15/08*** | (2006.01) |
| ***E04B 1/84*** | (2006.01) |

(52) U.S. Cl.

CPC ..... *E04F 13/147* (2013.01); *E04B 1/84* (2013.01); *E04F 15/08* (2013.01)

(58) Field of Classification Search

CPC ..... E04F 13/147; E04F 15/08; E04B 1/84

See application file for complete search history.

(56) References Cited

U.S. PATENT DOCUMENTS

| | | | | |
|---|---|---|---|---|
| 2,944,291 | A | 10/1957 | Prior et al. | |
| 3,421,597 | A * | 1/1969 | Blau | G10K 11/165 181/290 |
| 3,931,428 | A | 1/1976 | Reick | |
| 4,278,728 | A | 7/1981 | Honda | |
| 5,336,551 | A | 8/1994 | Gravier | |
| 5,631,053 | A | 5/1997 | Andersen | |
| 5,776,580 | A | 7/1998 | Rasmussen | |
| 6,688,061 | B2 | 2/2004 | Garcia | |
| 6,761,794 | B2 | 7/2004 | Mott | |
| 6,933,043 | B1 | 8/2005 | Son | |
| 7,255,907 | B2 | 8/2007 | Feigin et al. | |
| 7,399,510 | B2 | 7/2008 | Dupouy | |

(Continued)

FOREIGN PATENT DOCUMENTS

| | | |
|---|---|---|
| CN | 100419019 | 2/2007 |
| CN | 100429019 | 2/2007 |

(Continued)

OTHER PUBLICATIONS

International Search Report and Written Opinion of Corresponding Application No. NL 2025119 dated Jan. 14, 2021.

(Continued)

*Primary Examiner* — Patrick J Maestri

(74) *Attorney, Agent, or Firm* — Emerson, Thomson & Bennett, LLC; Roger D. Emerson; Peter R. Detorre

(57) ABSTRACT

The invention relates to a panel for constructing a floor or wall covering. The panel comprises a substantially planar top surface, at least one core layer composed of a composite material which core layer is provided with at least one cavity, and a bottom surface. The panel further comprises at least one pair of opposite edges, said pair of opposite edges preferably comprising complementary coupling parts configured for mutual coupling of adjacent panels.

19 Claims, 2 Drawing Sheets

(56) References Cited

U.S. PATENT DOCUMENTS

Figure 1A:
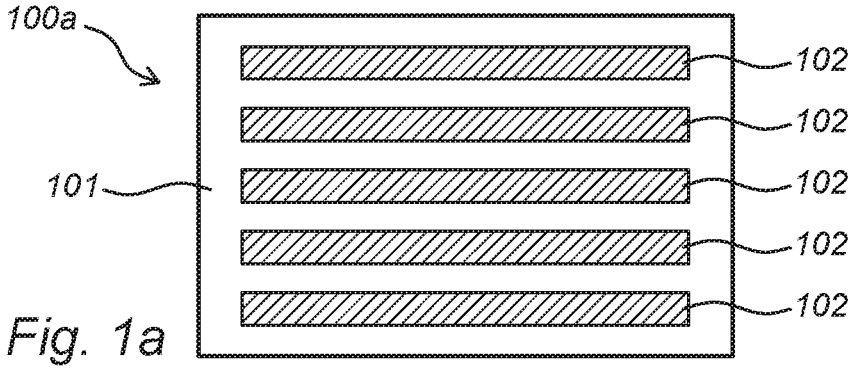

| | | | |
|---|---|---|---|
| 7,918,062 | B2 | 4/2011 | Chen |
| 8,287,991 | B2 | 10/2012 | Donelson |
| 8,419,877 | B2 | 4/2013 | Pervan |
| 10,328,680 | B2 | 6/2019 | Pervan |
| 10,828,881 | B2 | 11/2020 | Bergelin |
| 2005/0208258 | A1 | 9/2005 | Hosokawa |
| 2005/0286397 | A1 | 12/2005 | Inagaki |
| 2007/0033891 | A1 | 2/2007 | Imbabi |
| 2008/0149137 | A1 | 6/2008 | Steinbrenner |
| 2008/0318004 | A1 | 12/2008 | Ruhe |
| 2009/0011279 | A1 | 1/2009 | Wisenbaker, Jr. et al. |
| 2009/0017320 | A1 | 1/2009 | Donelson |
| 2009/0155612 | A1 | 6/2009 | Pervan |
| 2009/0235607 | A1 | 9/2009 | Chen |
| 2009/0308001 | A1 | 12/2009 | Wu |
| 2010/0115974 | A1 | 5/2010 | Okaza |
| 2011/0067336 | A1 | 3/2011 | McDonald |
| 2013/0295346 | A1 | 11/2013 | Ferguson |
| 2014/0087156 | A1 | 3/2014 | Sarkis |
| 2014/0134402 | A1 | 5/2014 | Pallon |
| 2014/0272302 | A1 | 9/2014 | Ciuperca |
| 2015/0059621 | A1 | 3/2015 | Hauber |
| 2016/0288447 | A1 | 10/2016 | Cordeiro |
| 2017/0204616 | A1 | 7/2017 | Scholz |
| 2017/0217133 | A1 | 8/2017 | Jordan et al. |
| 2018/0147873 | A1 | 5/2018 | De Mondt |
| 2018/0258651 | A1 | 9/2018 | Meersseman |
| 2018/0283014 | A1 | 10/2018 | Hodgkins et al. |
| 2019/0308914 | A1 | 10/2019 | Kong |
| 2020/0039190 | A1 | 2/2020 | Lenaerts |

FOREIGN PATENT DOCUMENTS

| | | | | |
|---|---|---|---|---|
| CN | 101386516 | | | 3/2009 |
| DE | 102012000468 | | | 7/2013 |
| EP | 2060389 | | | 5/2009 |
| EP | 2690142 | A1 | | 1/2014 |
| EP | 3536874 | | | 9/2019 |
| JP | H0828015 | | | 1/1996 |
| KR | 20140066086 | | | 5/2014 |
| SE | 19503648 | | * | 2/2019 |
| WO | 2012061300 | | | 5/2012 |
| WO | 2014007738 | | | 1/2014 |
| WO | 2018234561 | A1 | | 12/2018 |
| WO | 2019064113 | A1 | | 4/2019 |
| WO | 2020114645 | | | 6/2020 |
| WO | 2020197475 | | | 10/2020 |

OTHER PUBLICATIONS

International Search Report and Written Opinion of corresponding App. No. NL 2024807 dated Sep. 18, 2020.

International Search Report and Written Opinion of corresponding App. No. NL 2024806 dated Nov. 26, 2020.

International Search Report and Written Opinion of corresponding PCT Application No. NL2025684, dated Mar. 3, 2021.

* cited by examiner

PANEL AND METHOD OF PRODUCING A PANEL

The invention relates to a panel, in particular a floor panel, wall panel or ceiling panel. The invention also relates to a method for producing such panel.

The market of rigid floating floors has known a significant growth over the past years, evolving from thin flexible strips of vinyl or LVT (Luxury Vinyl Tiles) to thick, rigid engineered hybrid products integrating multiple layers that feature multiple benefits such as an unprecedented stability under temperature fluctuations, reduced chance of telegraphing or deformation on uneven subfloors and increased lock strength between panels. This development towards more rigid floor panels, typically having a polymeric core is carried by products such as WPC (Wood Plastic Composite, in effect a foamed PVC core with a density of around 900 kg/m3) and at a later stage SPC (Stone Plastic Composite, a solid PVC core with a density of around 2000 kg/m3). SPC gained ground on WPC due to its improved dimensional stability when subjected to temperature fluctuations, allowing for a larger installation surface area, and installation in hot and high-traffic areas. A disadvantage inherent to rigid floor SPC however is that its acoustic performance is unsatisfactory. Its sound performance underperforms with respect to the original, flexible and soft luxury vinyl tiles. In general, it can be said that an increase in filler or mineral content in the product, leads to a higher rigidity and an improved dimensional stability; but also to a worse acoustic performance. Acoustical performance in the flooring industry is understood as both the amplitude reduction of a sound wave when moving through the flooring (sound transmitted to room below) as well as reduction of amplitude when tested for reflected walking sound (the sound heard in the same room). The transmission sound reduction can be tested as "Delta IIC" or "Delta Lw". These two test methods give an indication of the sound transmission reduction to the room below due to the decorative flooring, it is the difference between sound transmission with or without the decorative flooring installed. To improve (reduce) this sound transmission, an underlay can be installed between the decorative flooring and the subfloor, or a pre-attached acoustic pad can be adhered to the back surface of the decorative flooring in the factory. Per illustration, a 4 mm SPC with a 1 mm pre-attached EVA backing can expect to reach a Delta Lw result of 12 dB; a WPC product with the same specifications routinely reaches 20 dB. The lower density of the WPC allows for an improved sound absorption. Again, as it contains a very low ratio of mineral content, it is therefore inherently less dimensionally stable compared to the solid core SPC. There is therefore need for a flooring product that features the benefits of both an SPC panel (rigid, no telegraphing, stable) and a WPC panel (lower density and improved acoustical performance).

It is a goal of the invention to provide a panel which at least partially has benefits of both an SPC and a WPC panel.

The invention provided thereto a panel, in particular a floor panel, a wall panel, or a ceiling panel, comprising at least one core layer comprising a composite material comprising a mineral material and preferably thermoplastic material, wherein the composite material comprises at least 20% by weight of mineral material, the core layer having a top surface and a bottom surface, wherein at least part of the bottom surface of the core layer is provided with at least one cavity which extends towards the top surface.

In a possible embodiment, the composite material comprises (a mixture of) mineral material and thermoplastic material. The panel according to the present invention is in particular configured for constructing a floor, wall or ceiling covering. The combination of a panel having a composite core layer comprising a mixture of mineral material and preferably thermoplastic material, which composite material comprises at least 20% by weight of mineral material and at least part of the bottom surface of said core layer being provided with at least one cavity extending towards the top surface of said core layer enables that the panel experiences an improved acoustical performance with respect to substantially solid panels without compromising on the rigidity of the panel. Due to the core layer of the panel comprising a composite material which comprises a mineral material, whereof at least 20% by weight is mineral material, a substantially rigid panel can be obtained. The presence of a core layer comprising at least 20% by weight of mineral material contributes to an increase of the rigidity of the panel in view of a panel having a core layer which is substantially entirely made of a thermoplastic material. Compared to a flexible panel, a substantially rigid panel facilitates relatively easy handling, and/or installation. Further, a substantially rigid panel is better equipped to bridge slight bumps and undulations in a subfloor without transferring them to the surface. This is in particular beneficial for use as floor panel, but rigidity of the panel may also be of benefit in case the panel is used as wall panel or ceiling panel. However, as outlined above, rigid panels typically experience an unsatisfying acoustic performance. This drawback is overcome by at least part of the bottom surface of the core layer being provided with at least one cavity which extends towards the top surface. The presence of at least one cavity in the bottom surface core layer which extends towards to top surface of the core layer causes at least one local reduction of material in the core layer. This may affect the absorption, transmission, reflection, refraction and/or the diffraction of sounds waves interacting with the panel. It is experimentally found that the combination of a composite core according to the present invention being provided with at least one cavity provides a positive effect on the acoustic performance of the panel, wherein a sound dampening effect is obtained. This is beneficial as it may eliminate the requirement of using an additional sound dampening layer underneath the panel. Another benefit of the combination of the composite material according to the present invention and at least one cavity is that the rigidity of the composite material may prevent undesired vibration of the panel during use. This is also positive for the overall performance of the panel during use.

At least part of the bottom surface of the core layer panel is typically substantially planar. In particular, the bottom surface generally defines a substantially planar surface. When it is referred to a cavity also the terms groove, slot, recess, opening, channel and/or depression could be used. The cavity is typically a cut-out part of the panel. Such cavity could either be formed during production of the panel or can be carved or cut-out afterwards. The cavity or cavities may for example be a localized recess formed in the bottom surface of the panel during the production process, for example during extrusion, substantially immediately after extrusion, during hot pressing, or prior to curing of the composite material forming the core of the panel. The panel is a typically a waterproof panel. Due to the good acoustic performance of the panel, the panel could also be referred to as acoustic panel.

The panel according to the present invention may for example be a substantially longitudinal panel. This is in particular beneficial in case the panel is used as floor panel.

However, it is also conceivable that the panel is substantially rectangular, rhombic, or polygonal.

At least one cavity may be present in a predetermined pattern. At least one cavity may for example extend from a first distal end of the panel to a second distal end of the panel. In such embodiment, said first distal end typically opposes said second distal end. It is also conceivable that at least one cavity is positioned at a predetermined distance from an edge of the panel. It is for example conceivable that at least one cavity does not extend through an (outer) edge of the panel. Hence, at least one cavity may be substantially centrally positioned. It is found that this is beneficial for the sound absorbing properties of the panel. Such embodiment may additionally ensure that the stability of the panel is not negatively affected by the cavity, or cavities if applied, as there is a pull-back strength provided by the bottommost surface thus formed. A non-limiting example of a predetermined pattern is for example a zig-zag pattern.

In a preferred embodiment of the panel, at least part of the bottom surface of the core layer is provided with a plurality of cavities. A plurality of cavities may further contribute to enhancing the acoustic performance of the panel. It is for example possible that the cavities are provided such that the (predetermined) pattern of cavities influences the acoustic properties, and in particular the sound dampening properties, of the panel. For such embodiment, typically at least one cavity extends in at least two direction within the same (horizontal plane). This may for example be the x- and z-direction, considering the cavity extends from the bottom surface towards the top surface of the core in the y-direction. At least one cavity may for example extend in at least two direction within a plane defined by the bottom surface of the core layer. Possibly, at least one cavity may extend in a direction other than the longitudinal direction of the panel in case the panel is substantially longitudinal. It is for example conceivable that the cavities extend in a combination of longitudinal and lateral directions. It is also conceivable that at least one, or all cavities, is/are substantially centrally positioned in the panel and/or do not extent through the (outer) edges of the panel. It is further conceivable that the cavities are positioned at a predetermined distance from another. It is also possible that the cavities form a network of interconnected cavities. This embodiment may in particular be beneficial as sound waves may travel through such interconnected cavities that sound travels through. The sound wave may lose its energy through friction between the air particles and the walls of the cavities where it is passing through. At least one outer edge and preferably all outer edges of the panel may be free of cavities. Hence, it is conceivable that the cavity or cavities do not extend through the outer edge(s) of the panel. It is for example conceivable that at least 1 cm from each outer edge of the panel is free of cavities.

The panel according to the present invention may comprise at least one pair of opposing (side) edges, said pair of opposing (side) edges comprising complementary coupling parts configured for mutual coupling of adjacent panels. The coupling parts of the panel may for example be interlocking coupling parts, which are preferably configured for providing both horizontal and vertical locking. Interlocking coupling parts are coupling parts that require elastic deformation, a click or a movement in multiple directions to couple or decouple the parts with or from each other. Any suitable interlocking coupling parts as known in the art could be applied. A non-limiting example is an embodiment wherein a first edge of said first pair of opposing edges comprises a first coupling part, and wherein a second edge of said first pair of opposing edges comprises a complementary second coupling part, said coupling parts allowing a plurality of panels to be mutually coupled; wherein the first coupling part comprises a sideward tongue extending in a direction substantially parallel to a plane defined by the panel, and wherein the second coupling part comprises a groove configured for accommodating at least a part of the sideward tongue of another panel, said groove being defined by an upper lip and a lower lip.

It is conceivable that the panel comprises at least one backing layer preferably attached to the bottom surface of the core layer. The backing layer may provide a protective function for the core layer, and thus for the panel as such. The backing layer may for example comprise an adhesive layer. This may then enable glue down installation of the panel according to the present invention. It is also conceivable that the backing layer is a balancing layer, preferably configured for stabilization and/or protection of the panel. A balancing layer may for example prevent cupping, warping and/or bowing of the panel. The balancing layer could also be referred to as stabilizing layer. It is also conceivable that at least one balancing layer is attached to top surface of the core layer. Possibly, the panel comprises a first balancing layer attached to the top surface of the core layer and a second balancing layer attached to the bottom surface of the core layer. The balancing layer may comprise lignocellulose and a cured resin. It is possible that the backing layer is substantially free of cavities. In such embodiment, the bottom surface of the core layer is provided with at least one cavity and the backing layer substantially fully covers said bottom surface of said core layer. The backing layer may thereby substantially seal the cavity or cavities. However, it is also conceivable that at least one cavity extends from the backing layer into the core layer. Hence, the shape of at least one cavity of the backing layer may follow, or substantially equal, the shape of at least one cavity of the bottom surface of the core layer. In either way, the presence of a backing layer may further contribute to the acoustic performance of the panel as the backing layer may have sound dampening properties and/or to the ease of installation of the panel. Further, the backing layer may form a moist barrier. The backing layer is typically made of a polymer material, for example but not limited to polyurethane. It is also conceivable that the panel comprises a combination of any of the mentioned examples of possible backing layers. Further, the backing layer may also be a sound absorbing layer. Such sound absorbing backing layer may further contribute to the good acoustic properties of the panel. Such backing layer may also be referred to as acoustic layer. The backing layer may be composed of a foamed layer, preferably a low density foamed layer, of ethylene-vinyl acetate (EVA), irradiation-crosslinked polyethylene (IXPE), expanded polypropylene (XPP) and/or expanded polystyrene (XPS). However, it is also conceivable that the backing layer comprises nonwoven fibers such as natural fibers like hemp or cork, and/or recycled/recyclable material such as PET. The backing layer, if applied, preferably has a density between 65 kg/m3 and 300 kg/m3, most preferably between 80 kg/m3 and 150 kg/m3.

It is beneficial if at least one cavity has a depth which is at least 20% of the total thickness of the panel. With the depth of the cavity a distance measure in the same spatial orientation as the thickness of the panel is considered. In general, in an assembled condition wherein panels are forming a floor covering, both the thickness of a panel and the dept of a cavity can be determined in a vertical orientation. It is also possible that at least one cavity has a depth which is at least 30% of the total thickness of the panel. Preferably, the dept of the cavities is not larger than 55% of the total thickness of the panel. The latter may prevent that deflection of the panel occurs when load is applied on top of the panel.

Due to the combination of rigidity and sound absorbing performance, a relatively thin panel could be applied. Preferably, the thickness of the panel is smaller than 3.5 cm, more preferably smaller than 2.75 cm. It is for example possible that the thickness of the panel is between 0.5 and 3 cm, preferably between 0.7 and 2.5 cm. Such thickness is substantially smaller than the thickness of a conventional acoustic (wall, floor or ceiling) panel.

In a further preferred embodiment, the planar surface area of the bottom surface of the core layer, is at least 30% less than the planar surface area of the top surface of the core layer. It is experimentally found that this difference further contributes to the acoustic performance of the panel whilst not affecting the rigidity and/or stability of the panel. The top surface of the core layer is typically substantially even and free of cavities.

It is possible that at least one cavity has a substantially curvilinear geometric cross section. This may be a cross section of the panel seen from a perpendicular direction with respect to a plane defined by the bottom surface of the core layer. This may further contribute to the desired absorption, transmission, reflection, refraction and/or the diffraction of sounds waves interacting with the panel. It is also possible that at least one cavity has a substantially curvilinear geometric shape within a plane defined by the bottom surface. Such shape may also contribute to the sound distribution within the material. It is further conceivable that part of the core layer which encloses a cavity has a structured surface. It is for example possible that the surface of the core layer enclosing the cavity is at least partially structured. This may also be a profiled or rough surface. Hence, the core layer may be partially provided with a profiled surfaced, preferably near or at the area defining a cavity. The cavity may for example be a substantially elongated cavity. It is further conceivable that at least part of at least one cavity is substantially cylindrical, pyramidical and/or conical. At least part of a cavity may for example be formed by a substantially half cylinder, in particular in a plane of the bottom surface. The depth of at least one cavity may vary over the length and/or width of the cavity. In particular, the shape of the cavities is to be chosen such that they provide enhanced dissipation of impact and/or airborne sound. Preferably, the geometric shape of at least one, and preferably all cavities, in the bottom surface of the core layer do not induce a difference in length- or crosswise flexibility. Hence, the geometric shape of the cavity or cavities is chosen such that it they do not negatively influence the rigidity of the panel.

In a further preferred embodiment, at least one cavity may be at least partially filled with a filler material such as sound absorbing material and/or soundproofing material.

This may further contribute to the sound absorbing character of the panel, and thus to the acoustic properties thereof. The sound absorbing material may for example be a natural material, such as bamboo, coco fibers and/or cork. Further non-limiting examples of sound absorbing material which could be used for the present invention are mineral wool, fiberglass, and/or polystyrene foam. In a further possible embodiment, at least one cavity may be substantially completely filled with sound absorbing material.

It is further conceivable that at least one core layer is composed of a composite material comprising at least 40% by weight of mineral material, preferably at least 50% by weight, more preferably at least 60% by weight. It is also possible that the core layer comprises at least 80% by weight of mineral material. A higher mineral content typically results in a more rigid panel. Moreover, due to the relatively large quantity of mineral material and the relatively low quantity of thermoplastic material in the composite core layer, a significantly improved temperature resistance can be obtained, in particular with respect to conventional floor panel having a core which is predominantly PVC based. Hence, the panel according to the invention does no longer suffer from undesired shrinking and expansion due to seasonal and/or local temperature changes.

It is conceivable that at least one core layer comprises at least one mineral material selected from the group consisting of: magnesium oxide, calcium carbonate, chalk, clay, calcium silicate and/or talc. These materials have proven to impart a sufficient rigidity to the composite material. As a further non-limiting example, limestone (e.g. calcium carbonate with magnesium carbonate) may be used as mineral material in the core layer. Possibly, the mineral material is present as particulate mineral filler.

Typically, the core layer of a panel according to the present invention is composed of a composite material comprising a mixture of mineral material and thermoplastic material. Non limiting examples of thermoplastic material are polyvinyl chloride (PVC), polyethylene (PE), polyurethane (PU), acrylonitrile butadiene styrene (ABS) and/or polypropylene (PP). The thermoplastic material may also be a vinyl containing thermoplastic material. The core layer may also comprise a mixture of aforementioned materials. Generally, the ratio of weight percentages of mineral material relative to thermoplastic material is at least 1. Preferably, the composite material comprises at least 15% by weight of thermoplastic material. This lower limit is found to be sufficient to secure sufficient stability and strength of the core layer. The composite material preferably comprises a maximum of 40% by weight of thermoplastic material. This maximum is preferred in order to improve the rigidity of the core layer as well as to seriously improve the temperature resistance of the core layer.

The panel, and in particular the core layer may further comprise at least one binder. Preferably, the ratio of weight percentages of mineral material relative to said binder is at least 1.

The core layer may further comprise at least one additive chosen from the group consisting of: a pigment, an impact modifier, a lubricant, a stabilizer, a wax, and/or an aid processing agent. Various pigments, such as inks, to impart colour to the composite layer. If applied, pigments are commonly present in an amount of 0-5% by weight in the composite layer. As impact modifier, preferably MBS (Methacrylate-Butadiene-Styrene), CPVC (chlorinated PVC), ABS (acrylonitrile butadiene styrene) or TPE (thermoplastic elastomer) is used, which is more preferably present in an amount of 0-5% by weight in the composite core layer. Also, at least one lubricant may be present and more preferably an internal lubricant and an external lubricant. The optional stabilizer can be selected for effectiveness with the particular polymer used and may for example be a calcium zinc stabilizer. Preferably, the total amount of additives present in the composite core layer is restricted to 1-15% by weight, more preferably 5-15% by weight, and most preferably 8-12% by weight. The core layer is in a possible embodiment substantially free of natural organic fibres, and in particular substantially free of wood (for example wood fibres, and including wood dust, and bamboo dust).

The panel according to the present invention is possibly substantially rectangular, but may also be substantially rhombic, or substantially polygonal. In a preferred embodiment, the flexibility of the panel in the longitudinal direction is substantially equal to the flexibility of the panel in the lateral direction. For example in case of a substantially square or square-ish panel, it is also conceivable that the flexibility of the panel in a first direction is substantially equal to the flexibility in a second direction, wherein the first direction and the second direction are defined within the same plane surface and wherein the directional component of the first direction is substantially perpendicular to directional component of the second direction. With substantially equal it is meant that the average measuring deviation between the longitudinal and lateral direction is within 10%, and preferably within 5%. A benefit of such embodiment is that a relatively rigid and stable panel can be obtained. The cavity, or cavities, are preferably positioned such that the flexibility of the panel is not significantly affected, in particular in at least one direction, and possibly in a single direction. It is for example conceivable that the cavity/cavities is/are positioned such that it does not affect the flexibility in a first direction, for example, but not limited to, the longitudinal direction.

The modulus of rigidity of the panel is preferably at least 2500 MPa. In a further preferred embodiment, the modulus rigidity of the panel in the longitudinal direction is at least 2500 MPa and/or wherein the modulus rigidity of the panel in the lateral direction is at least 2500 MPa. The rigidity is generally measured according to NEN-EN 310 standards.

It is conceivable that the core layer is an extruded layer formed via an extrusion process. A benefit of a core layer being formed via an extrusion process is that the panels can be produced in a relatively cheap way. Further, an extruded core layer is found to be advantageous in regard of the rigidity obtained, as well as being capable of forming a fusion bonding with the top layer. Here, the extrusion process and the fusion process can be performed simultaneously during production of the panel. It is in particular beneficial if at least one cavity is formed during the extrusion process. In this manner it can be prevented that material is to be removed from the core after production of the panel. Hence, the panel can be produced in a more efficient way. Further, it is prevented that residual material is formed. It is also conceivable that at least one cavity is formed substantially immediately after an extrusion process. In this context, it is meant that at least one cavity is formed prior to the core being solidified.

In another possible embodiment, it is conceivable that the core layer is formed via hot-pressing. For this technique it is possible that at least one cavity is formed during production and/or that at least one cavity is provided afterward production of the panel. Hot pressing may positively contribute to the rigidity of the panel. It is also conceivable that the core layer is formed via a curing process. For this technique it is also possible that at least one cavity is formed during production and/or that at least one cavity is provided afterward production of the panel.

The panel may further comprise at least one reinforcement layer. Non-limiting examples of such reinforcement layer are fiber glass, polypropylene, jute, cotton and/or polyethylene terephthalate. It is in particular beneficial if the reinforcement layer is at least partially impregnated with a thermosetting resin. Such thermosetting resin may be selected from the group comprising of: melamine formaldehyde resin, phenolic resins and/or urea formaldehyde. Typically, a reinforcement layer, if applied, is present near the top surface and/or near the bottom surface of the panel. In particular, the reinforcement layer is attached to core layer.

The panel according to the invention may further comprise at least one top layer, preferably a decorative top layer. Such decorative top layer may for example be a high pressure laminate (HPL), a plurality of impregnated layers containing lignocellulose, a wood veneer, a thermoplastic layer containing at least a decorative layer and optionally a protective top layer, a stone veneer or the like, and/or a combination of said decorative layers. The decorative top layer may possibly also comprise at least one ply of cellulose-based layer and a cured resin, wherein the cellulose-based layer is preferably paper or kraft paper. Said ply of cellulose-based material may also be a veneer layer adhered to a top surface of the core layer. The veneer layer is preferably selected from the group consisting of wood veneer, cork veneer, bamboo veneer, and the like. Other decorative top layers that can be considered according to the invention include ceramic tiles or porcelain, a real stone veneer, a rubber veneer, a decorative plastic or vinyl, linoleum, and decorative thermoplastic film or foil which may be laminated with a wear layer and optionally a coating. Examples of thermoplastics may be PP, PET, PVC and the like. It is also possible to provide on the top facing surface of the core an optional primer and print the desired visual effect in a direct printing process. The decorative layer can receive a further finishing with a thermosetting varnish or lacquer such as polyurethane, PUR, or a melamine based resin. It is also conceivable that the panel comprises a top layer consisting of a ceramic tile. Such ceramic tile may for example be attached to the top surface of the core layer by means of an adhesive, such as but not limited to polyurethane. It is also conceivable that the top layer is made of a ceramic and/or stone material. Hence, the invention also relates to a panel, in particular a floor panel, a wall panel, or a ceiling panel, comprising at least one core layer comprising a composite material, the composite material preferably comprising at least 20% by weight of mineral material, the core layer having a top surface and a bottom surface, wherein at least part of the bottom surface of the core layer is provided with at least one cavity extending towards the top surface, and wherein the panel comprises at least one top layer attached to the top surface of the core layer, the top layer comprising a stone and/or ceramic material. Preferably, the top layer is a stone and/or ceramic tile.

The invention also relates to a method for producing a panel, in particular a floor panel, a wall panel, or a ceiling panel, preferably according to the present invention, the method comprising the steps of:

- providing a composite material, preferably a substantially liquid composite material, the composite material comprising at least 20% by weight of mineral material,
- forming a core layer of said composite material wherein said core layer has a top surface and a bottom surface,
- providing at least one cavity in at least part of the bottom surface of the core layer which extends towards the top surface, and
- enabling hardening and/or curing of the core layer.

Forming of the core layer may for example be done via extrusion. The method may further comprise the step of providing and attaching at least one backing layer to the bottom surface of the core layer and/or providing and attaching at least one top layer to the top surface of the core layer. The method may also comprise the step of machining of at least two edges of the panel which that complementary coupling parts are provided.

The invention will now be elucidated into more detail with reference to the following non-limitative figures. Herein show:

FIGS. 1*a*-1*d* each a bottom view of possible embodiments of a panel according to the present invention; and FIGS. 2*a*-2*e* each a cross section of possible embodiments of a panel according to the present invention/

FIGS. 1*a*-1*d* shows schematic representations of possible embodiments of panels 100 according to the present invention. The figures show a bottom view of the panel 100. Each panel 100*a*, 100*b*, 100*c*, 100*d* can for example be a floor panel 100, a wall panel 100, or a ceiling panel 100. Each panel comprises a core layer 101, preferably comprising a composite material comprising a mixture of mineral material and thermoplastic material. Each core layer 101 has a top surface (not shown) and a bottom surface which is shown in the picture. Part of the bottom surface of the core layer 101 of each panel 100*a*, 100*b*, 100*c*, 100*d* is provided with at least one cavity 102 which extends towards the top surface of the core layer 101. In the shown embodiments, the panels 100*a*, 100*b*, 100*c*, 100*d* are not provided with (interlocking) coupling means. However, it is conceivable that said coupling means are applied.

Figure 1B:
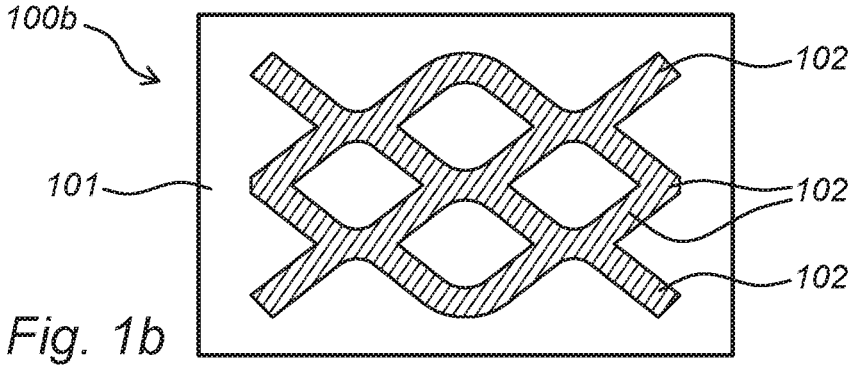
Figure 1C:
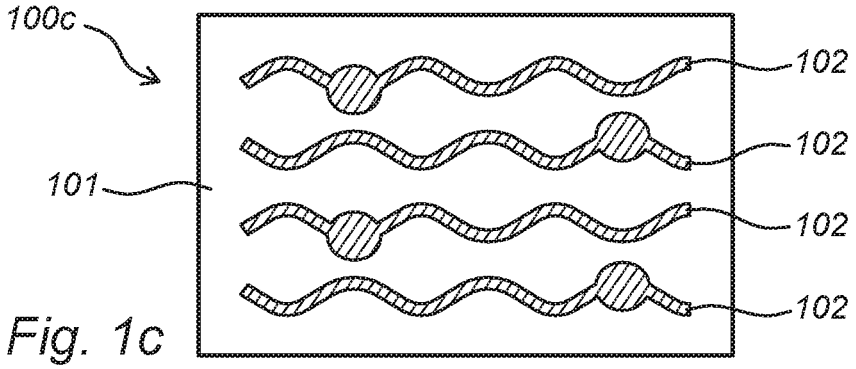
Figure 1D:
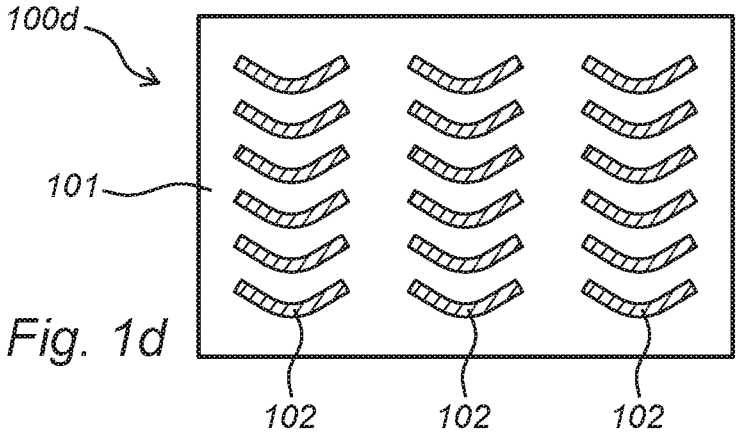

FIG. 1*a* shows a panel 100*a* comprises a plurality of substantially parallel cavities 102. Each cavity 102 is positioned at a predetermined distance from the peripheral edges of the panel 100*a*. It can also be seen that each cavity 102 extends in longitudinal direction of the panel 100*a*. FIG. 1*b* shows a panel 100*b* wherein the cavities 102 form a network of interconnected cavities 102. It is experimentally found that such embodiment may strengthen the sound dampening effect of the panel 100*b*. FIG. 1*c* shows a panel 100*c* with a plurality of individual cavities 102 which extend substantially in the longitudinal direction of the panel 100*c*. The cavities 102 are locally widened. At least the locally widened areas may for example be filled with sound absorbing material. FIG. 1*d* shows a panel 100*d* having series of substantially V-shaped cavities 102. The cavities 102 are positioned at a predetermined distance from another and do not interfere with an adjacent cavity 102.

Figure 2A:
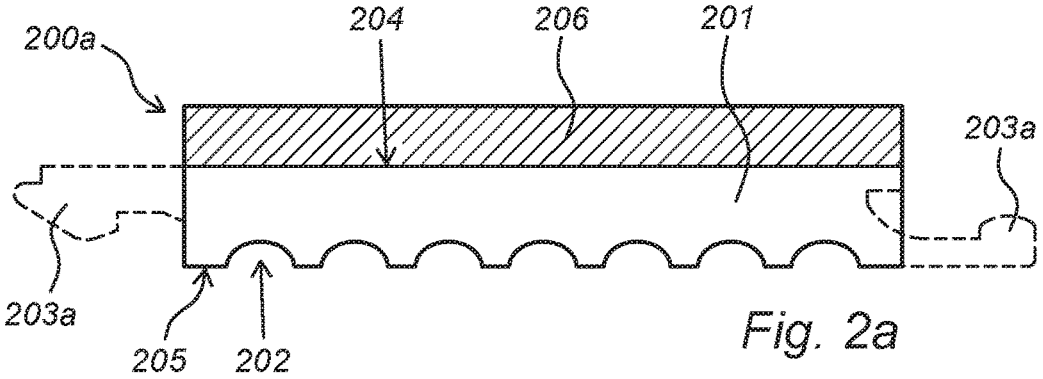

FIG. 2*a*-2*e* show further possible embodiments of panels 200 according to the present invention. Each figure shows a side view of a cross section of a panel 200*a*, 200*b*, 200*c*, 200*d*, 200*e* which could be a floor panel 200, wall panel 200 or ceiling panel 200. FIG. 2*a* shows that the panel 200 can optionally be provided with interconnecting coupling parts 203*a*, 203*b*. Interconnecting coupling parts 203*a*, 203*b* could be applied to any of the embodiments covered by the present invention. Each panel 200 comprises a core layer 201, preferably comprising a composite material comprising a mixture of mineral material and thermoplastic material. Each core layer 201 has a top surface 204 and a bottom surface 205.

Figure 2B:
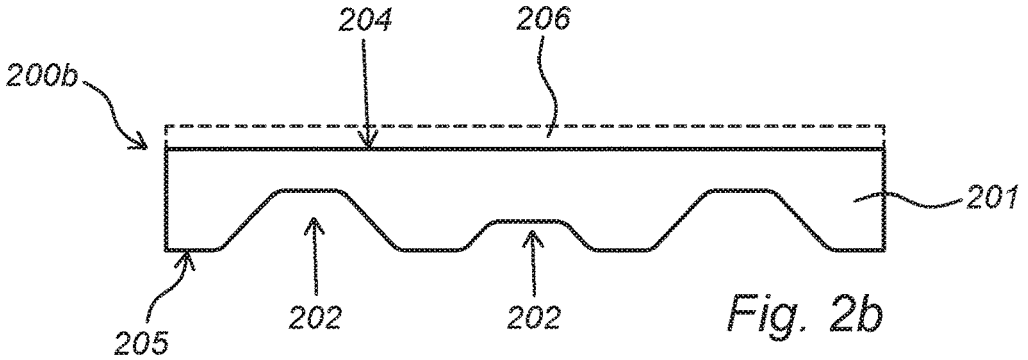
Figure 2C:
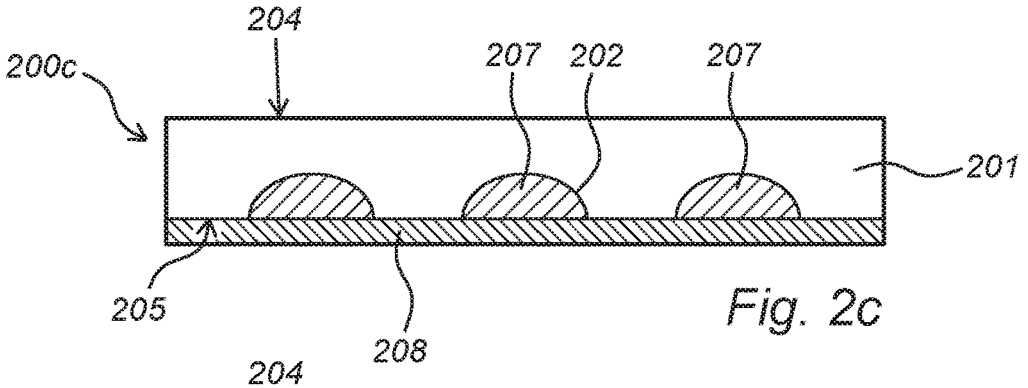
Figure 2D:
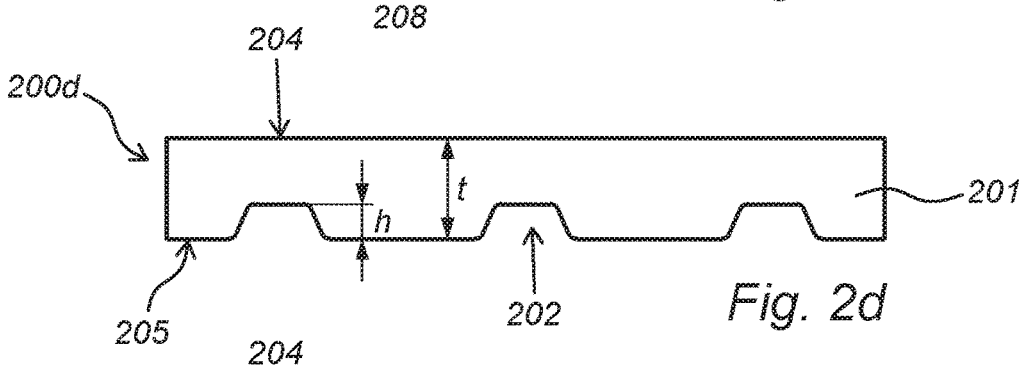
Figure 2E:
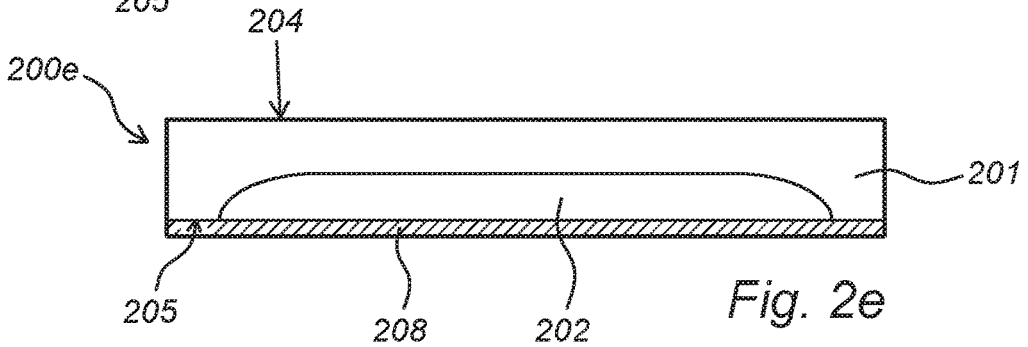

FIG. 2*a* shows a panel 200*a* comprising a plurality of cavities 202 which are positioned at predetermined distance from another. The panel 200*a* further comprises a top layer 206. In the shown embodiment the top layer 206 is a ceramic panel 206 attached to the top surface 204 of the core layer 201. FIG. 2*b* shows a panel 200*b* wherein the depth the cavities 202 differs per cavity 202. The cavities 202 are substantially trapezium shaped in cross section. Optionally, the panel 200*b* may comprise a decorative top layer. FIG. 2*c* shows an embodiment wherein the cavities 202 have a cross section which is semicircular. The cavities 202 are filled with sound absorbing material 207. The panel 200*c* further comprises a backing layer 208 which is attached to the bottom surface 205 of the core layer 201. FIG. 2*d* shows that the height, or depth, h of the cavities 202 is at least 20% of the total thickness t of the panel 200*d*. In particular, the depth h of the cavities 202 is about $\frac{1}{3}^{rd}$ of the thickness t of the panel 200*d*. FIG. 2*e* shows a side view of a panel 200*e* wherein it can be seen that the cavity 202 extends over substantially the entire length of the panel 200*e* but that the cavity 202 starts and ends at a predetermined distance from the outer ends of the panel 200*e*. The panel 200*e* further comprises a backing layer 208, in particular a balancing layer 208. The cavity 202 is free of filling material, such as a sound absorbing material. It will be apparent that the invention is not limited to the working examples shown and described herein, but that numerous variants are possible within the scope of the attached claims that will be obvious to a person skilled in the art.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "comprise" and conjugations thereof used in this patent publication are understood to mean not only "comprise", but are also understood to mean the phrases "contain", "substantially consist of", "formed by" and conjugations thereof. When it is referred to reinforcing layer also a reinforcing element can be meant, or vice versa.

The invention claimed is:

1. A floor panel, a wall panel, or a ceiling panel, comprising:

at least one core layer comprising a composite material comprising at least 20% by weight of mineral material, the core layer having a top surface and a bottom surface, at least one decorative top layer provided at the top surface of the core layer;

wherein at least part of the bottom surface of the core layer is provided with at least one cavity which extends towards the top surface, wherein at least part of the bottom surface of the core layer is provided with at least one cavity having a depth and a width, and wherein at least one cavity has a substantially curvilinear geometric shape in the plane defined by the bottom surface of the core.

2. The panel according to claim 1, wherein the panel comprises at least one pair of opposing side edges, said pair of opposing side edges comprising complementary coupling parts configured for mutual coupling of adjacent panels.

3. The panel according to claim 1 comprising at least one backing layer attached to the bottom surface of the core layer.

4. The panel according to claim 3, wherein the backing layer comprises an adhesive layer.

5. The panel according to claim 3, wherein the backing layer is a balancing layer.

6. The panel according to claim 3, wherein the backing layer is an acoustic layer.

7. The panel according to claim 3, wherein the backing layer is substantially free of cavities.

8. The panel according to claim 3, wherein at least one cavity extends from the core into the backing layer, further wherein at least one cavity has a depth which is at least 20% of the total thickness of the panel.

9. The panel according to claim 1, wherein at least part of at least one cavity is substantially cylindrical, pyramidical and/or conical in shape and is perpendicular to the plane defined by the bottom surface of the core.

10. The panel according to claim 1, wherein i) the depth of at least one cavity varies over the width and/or length of the cavity and wherein the depth of at least two cavities is different or ii) wherein the depth of at least two cavities is different.

11. The panel according to claim 1, wherein at least one cavity is filled with sound absorbing material.

12. The panel according to claim 1, wherein the core layer comprises at least 40% by weight of mineral material, wherein the core layer comprises at least one mineral material selected from the group consisting of: magnesium oxide, calcium carbonate, chalk, clay, calcium silicate and/or talc.

13. The panel according to claim 1 comprising at least one binder, wherein the ratio of weight percentages of mineral material relative to said binder is at least 1:1.

14. The panel according to claim 1, wherein the core layer further comprises at least one additive chosen from the group consisting of: a pigment, an impact modifier, a lubricant, a stabilizer, and a wax.

15. The panel according to claim 1, wherein the flexibility of the panel in the longitudinal direction is substantially equal to the flexibility of the panel in the lateral direction, wherein the modulus of rigidity of the panel in the longitudinal direction is at least 2500 MPa and/or wherein the modulus of rigidity of the panel in the lateral direction is at least 2500 MPa.

16. The panel according to claim 1 comprising at least one reinforcement layer.

17. The panel according to claim 2, wherein all edges of the panel are free of cavities.

18. A method for producing a panel, a floor panel, a wall panel, or a ceiling panel according to claim 1, comprising the steps of:

providing a composite material, a substantially liquid composite material, comprising at least 20% by weight of mineral material, forming a core layer of said composite material wherein said core layer has a top surface and a bottom surface, providing at least one cavity in at least part of the bottom surface of the core layer which extends towards the top surface, enabling hardening and/or curing of the core layer, and optionally, applying a decorative top layer.

19. The panel according to claim 1, wherein at least part of the bottom surface of the core layer is provided with a plurality of cavities, wherein the plurality of cavities form a network of interconnected cavities.

* * * * *